US007950438B2

(12) United States Patent
Albert

(10) Patent No.: US 7,950,438 B2
(45) Date of Patent: May 31, 2011

(54) DOORWAY SCREENING APPARATUS

(76) Inventor: Robert Albert, Oakley, MI (US)

( * ) Notice: Subject to any disclaimer, the term of this patent is extended or adjusted under 35 U.S.C. 154(b) by 450 days.

(21) Appl. No.: 12/077,657

(22) Filed: Mar. 20, 2008

(65) Prior Publication Data

US 2008/0230188 A1 Sep. 25, 2008

Related U.S. Application Data

(60) Provisional application No. 60/895,831, filed on Mar. 20, 2007.

(51) Int. Cl.
*E05D 15/00* (2006.01)
*E05D 15/26* (2006.01)

(52) U.S. Cl. ..... 160/201; 160/205; 160/207; 160/214

(58) Field of Classification Search ..... 160/89, 160/90, 113, 114, 185, 188, 193, 201, 202, 160/208, 210, 214, 218, 203
See application file for complete search history.

(56) References Cited

U.S. PATENT DOCUMENTS

| | | | | | |
|---|---|---|---|---|---|
| 1,492,420 | A * | 4/1924 | Burke et al. | ..... | 160/193 |
| 1,537,300 | A * | 5/1925 | Haines | ..... | 160/185 |
| 1,606,976 | A * | 11/1926 | Tomkinson | ..... | 160/202 |
| 1,788,651 | A * | 1/1931 | Alderson | ..... | 160/193 |
| 1,872,489 | A * | 8/1932 | Mitchell | ..... | 160/191 |
| 1,892,340 | A * | 12/1932 | Guth | ..... | 160/147 |
| 2,434,559 | A * | 1/1948 | Garcia | ..... | 160/37 |
| 3,021,896 | A * | 2/1962 | Buono et al. | ..... | 160/113 |
| 3,082,759 | A * | 3/1963 | Edmonds et al. | ..... | 126/546 |
| 3,262,488 | A * | 7/1966 | Rieder | ..... | 160/202 |
| 4,653,566 | A * | 3/1987 | Miale | ..... | 160/201 |
| 4,673,019 | A | 6/1987 | Silverthorne et al. | | |
| 5,611,382 | A * | 3/1997 | Sferra | ..... | 160/113 |
| 5,685,355 | A * | 11/1997 | Cook et al. | ..... | 160/202 |
| 5,899,254 | A | 5/1999 | Cook | | |
| 5,988,256 | A | 11/1999 | Winters | | |
| 6,053,235 | A | 4/2000 | Ruffner, Sr. | | |
| 6,705,378 | B1 | 3/2004 | Smidt | | |
| 7,086,442 | B1 * | 8/2006 | Esparza | ..... | 160/113 |
| 7,121,316 | B2 * | 10/2006 | Biggers | ..... | 160/183 |
| 7,143,803 | B2 * | 12/2006 | Mitchell | ..... | 160/113 |
| 2005/0126721 | A1 * | 6/2005 | Fan | ..... | 160/201 |
| 2005/0217803 | A1 * | 10/2005 | Mitchell | ..... | 160/113 |
| 2006/0175027 | A1 * | 8/2006 | Langenbach | ..... | 160/218 |

* cited by examiner

*Primary Examiner* — Blair M Johnson
*Assistant Examiner* — Jaime F Cardenas-Garcia
(74) *Attorney, Agent, or Firm* — Robert L. Farris; Farris Law, P.C.; John K. McCulloch

(57) ABSTRACT

A screen closure for a garage doorway has a plurality of screened panels movable from an elevated, stored position in which such panels are side-by-side to an extended, operative position in which the panels extend vertically a distance sufficient to close the doorway. Those panels which are at eye level and below when the panels are in their extended position are substantially coplanar.

19 Claims, 9 Drawing Sheets

DOORWAY SCREENING APPARATUS

CROSS REFERENCE TO RELATED APPLICATION

This application claims the benefit of the filing date of U.S. Provisional application No. 60/895,831, filed Mar. 20, 2007.

This invention relates to apparatus for screening a garage doorway by means of a plurality of screen panels movable between an elevated, stored position in which the doorway is open and a lowered operative position in which the doorway is closed and screened by such panels.

BACKGROUND OF THE INVENTION

It is not uncommon for a home owner whose home has a garage to provide apparatus for screening the door opening when the garage door is open, thereby providing an area for recreational or social activities which preferably are engaged in outside the living quarters of the home. However, when the garage area is to be used for such activities it is preferable that the garage door occupy its open position, thereby enabling fresh air to enter the garage and providing a view to the occupants other than that of the inside of the garage door. One of the problems associated with utilizing the garage area with the garage door open is restraining the access to the garage area of annoying insects, other pests, and air borne debris.

The prior art contains many examples of apparatus for screening an open garage doorway. However, not all of them have been well received for a number of reasons. One of such reasons is that the screening apparatus and the garage door interfere with one another unless precautions are taken to avoid the interference. In many instances the precautions require the installation of apparatus which requires adjustment or reconfiguration of the means for enabling movement of the garage door, sometimes necessitating the provision of complex arrangements for effecting operation of both the door and the screening apparatus.

Some of the constructions proposed heretofore employ framed panels provided with screening material and which are movable as a unit between positions in which the doorway is closed or open. In many instances the screening apparatus is stored at a level above that of the garage door when the latter is in its open position. Locating the screening apparatus in such position exposes it to the collection of dust and air borne debris, thereby necessitating cleaning of the apparatus when it is used to screen the doorway. In addition, the storage of the screening apparatus at a level above that of the open garage door may make it impossible to utilize upper portions of a garage for storage of other equipment or materials.

A principal object of the invention is to provide screening apparatus for a garage doorway which overcomes the objections referred to above.

SUMMARY OF THE INVENTION

A garage has a doorway which selectively may be closed and opened so as to permit a vehicle to pass through the doorway into and out of the garage. Doorway screening is provided and is movable from an elevated, stored position to a lowered, operative position in which the doorway is screened so as to enable fresh air to circulate while preventing the admission to the garage of insects and other undesirable materials.

The screening apparatus comprises a plurality of panels each of which is of such length as to span the width of the doorway and each of which has frame members which encircle screening material. When the screening apparatus is in its elevated, stored position all of the panels are arranged side-by-side in a storage zone which does not preclude the storage of other materials at a level above the garage door when the latter is in its doorway-open position. The panels also occupy a vertical position so as to minimize the collection of dust and the like on the panels.

The screening panels are of such length as to span the garage door opening which is defined by frame members forming part of the garage. The panels and the frame members are provided with cooperative guide means which guide the panels during their vertical movements between the operative position and the stored position.

A drive apparatus is provided and coupled to one or more selected panels so as to effect vertical movement of the panels. The drive apparatus is reversible, thereby enabling it to lower and raise the screening panels.

The arrangement is such that downward movement of the screening apparatus is initiated by downward movement of that panel which is connected to the drive apparatus, such movement enabling downward movement of all of the other panels. Downward movement of the drive-connected panel is followed by downward movement of another, adjacent panel along a vertical path, such adjacent panel being coupled to the drive-connected panel. After a predetermined distance of downward movement of the drive-connected panel such movement will be interrupted by a stop member, following which the drive-coupled panel is permitted to swing automatically by gravity to an adjusted position in which the drive-coupled panel will engage the stop member and displace it to a position in which the drive connected panel is able to continue its downward movement to its final position. The drive-coupled panel will continue its downward, swinging movement until it occupies a downward position beneath, in prolongation of, and coplanar with the drive-connected panel.

A further panel is connected to the drive-coupled panel for downward movement therewith and for swinging movement relative thereto. As such drive-coupled panel approaches its final position, which is in prolongation of and coplanar with the drive-connected panel, such further panel that is connected to the drive-coupled panel will move downwardly and into a position in which it extends in prolongation of and is coplanar with the drive-connected and the drive-coupled panels.

Guide means carried by the panels and by the doorway frame members will engage one another and guide the panels to their final, downward positions in which they, together with the other panels, form a screened closure for the garage doorway.

When it is desired to return the screening panels to their elevated, stored positions upward movement of the drive-connected panel is initiated by the drive means, whereupon the cooperative guides between the two lower panels and the doorway frame members cause the lower two panels to swing outwardly as they move upwardly. Continued upward movement of the drive-connected panel will effect corresponding movement of the lowest panel and the drive-coupled panel which is adjacent and hinged to the drive-connected panel. As the drive-coupled panel adjacent the drive connected panel continues to move upwardly it will disengage the cam surface of the stop member and enable it to return to its projected position for arresting movement of the drive-connected panel when the panels are recycled to their downward, screening positions.

In the stored position the panels are in upright position so there is little likelihood that dust and airborne debris will settle on the screen material.

In all positions of the screening panels the garage door is operable to open and close the doorway. As a consequence no adjustment of either the garage door or the screening apparatus is required.

THE DRAWINGS

Apparatus constructed in accordance with the invention is illustrated in the accompanying drawings wherein.

THE DISCLOSED EMBODIMENT

Figure 1:
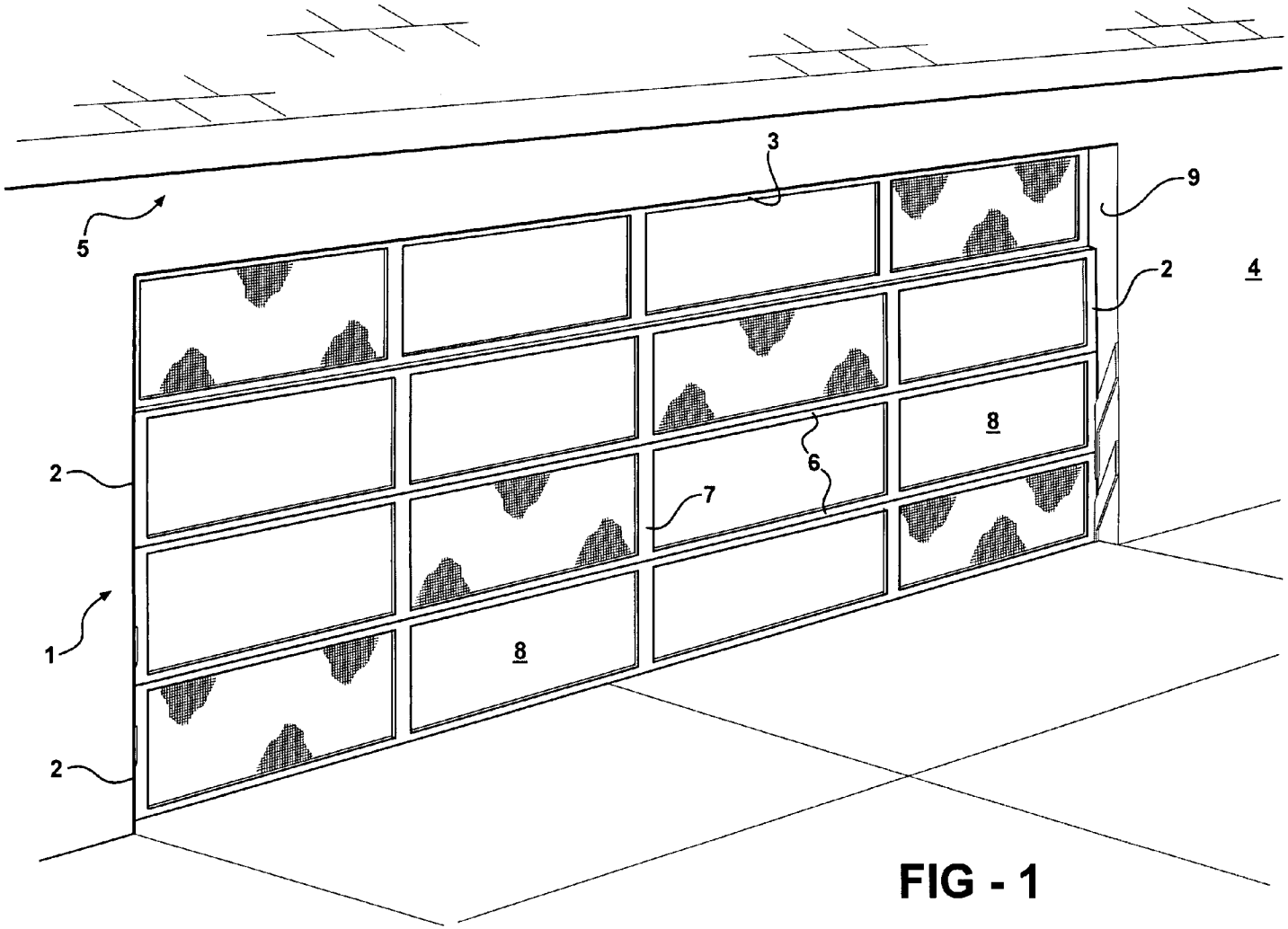
FIG. 1 is a fragmentary, isometric view of a building having an attached garage and an opening through which one or more vehicles may pass into and out of the garage, such doorway being closed by screening apparatus constructed in accordance with the invention.

A garage doorway screen is indicated generally by reference character 1 in FIG. 1 and is capable of vertical movements between adjusted positions and comprises a plurality of panels 2 of such combined length as to span a doorway 3 formed in a wall 4 of a building 5. The panels also are of such height that, together, they may extend the full height of the doorway. Each panel is substantially the same and has horizontal and vertical frame members 6 and 7, respectively which encircle or enclose screen material 8 so as to enable air freely to flow through each of the panels.

The garage doorway 1 is formed by vertical frame members 9 and a horizontal header 10 which defines the upper edge of the doorway. The construction of the doorway is conventional.

The doorway is adapted to be closed and opened by a garage door 11 which also is composed of panels hingedly connected to one another, as also is conventional. Some of the garage door panels are fitted with brackets 12 which support guide rollers 14 which are movably accommodated in guide tracks 15 mounted with the confines of the garage, as is customary. The garage door also carries a bracket 16 that is pivoted to one end of an operating arm 17 the opposite end of which is pivoted to a slide 18 mounted on a guide bar 19 secured at one end to a support 20. The slide also is connected to one end of a door operator (not shown) by means of which the door 11 may be raised and lowered in a conventional manner.

Figure 10:
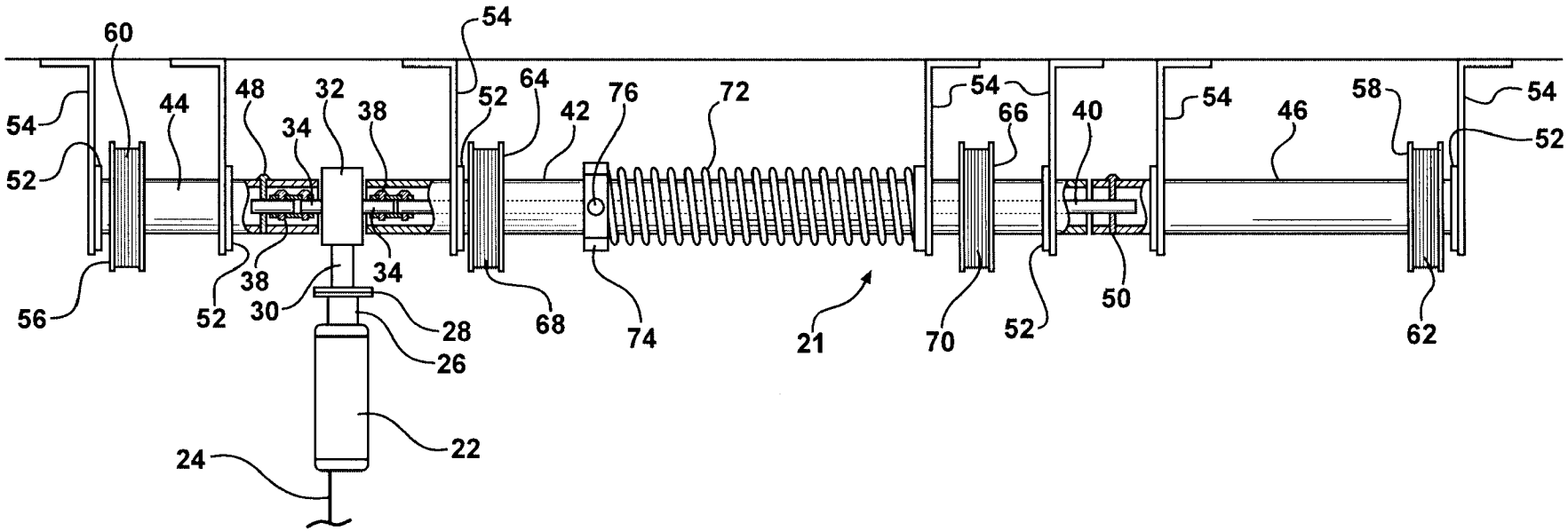
FIG. 10 is a top plan view, partly in section, on a reduced scale of a motorized drive mechanism by means of which the screen panels may be lowered and raised.

The disclosed embodiment includes a power drive assembly 21 (FIG. 10) for moving the screen 1 vertically so as selectively to close and open the doorway 3. The screen drive assembly 21 is completely independent of the garage door operator.

The screen drive assembly 21 comprises an electric motor 22 connected by a suitable connector 24 to a source of energy. The motor has a rotary shaft 26 connected by a clutch 28 to a shaft 30 of a gear box 32 having laterally projecting stub shafts 34 extending from opposite sides thereof. The motor 22 is mounted on a support 36 within the garage.

Each stub shaft 34 is coupled by a coupling 38 to a drive shaft 40. The drive shaft is encircled by and extends completely through a cylindrical shaft 42 and partially through two cylindrical shafts 44 and 46 which are coupled to and outboard of the drive shaft 40 by pins 48 and 50. The shafts 42, 44, and 46 are journaled in bearings 52 carried by brackets 54 secured to the header assembly 10.

Fixed to the shaft sections 44 and 46 are two outboard spools 56 and 58 around which are wound hoist cables 60 and 62, respectively. The free ends of the cables 60 and 62 are secured to one of the screen panels as will be explained more fully shortly. Fixed to the shaft 42 is a pair of spools 64 and 66 around each of which is wound a force transmitting cable 68 and 70, respectively.

Encircling the shaft 42 is a counterbalance torsion spring 72 that is fixed at one end to one of the brackets 54 and at the other to a collar 74 by means of a set screw 76. The arrangement is such that rotation of the shafts 44 and 46 by the drive motor 22 effects winding on or unwinding from the outboard spools 56 and 58 the respective hoist cables 60 and 62, depending upon the direction of rotation of the shafts 44 and 46. As will be explained hereinafter the cables 68 and 70 that are wound on the inboard spools 64 and 66 are fixed at their free ends to one of the screen panels so that vertical movements of the latter will be imparted via the cables to the shaft 42. Rotation of the shaft 42 is counterbalanced by the torsion spring 72.

The screen panels 2 are designated P-1, P-2, P-3, and P-4, and each of such panels preferably is of uniform size and area such that the combined area of panels corresponds substantially to the area of the doorway and will close the latter when the panels are in their operative position as shown in FIG. 1. The panels are movable between their operative, or doorway screening position, shown in FIG. 1 and their elevated, stored position shown in FIG. 2. Such movements are effected by the hoist cables 60 and 62 and the movements of individual panels relative to one another are controlled by the force transmitting cables 68 and 70.

Figure 2:
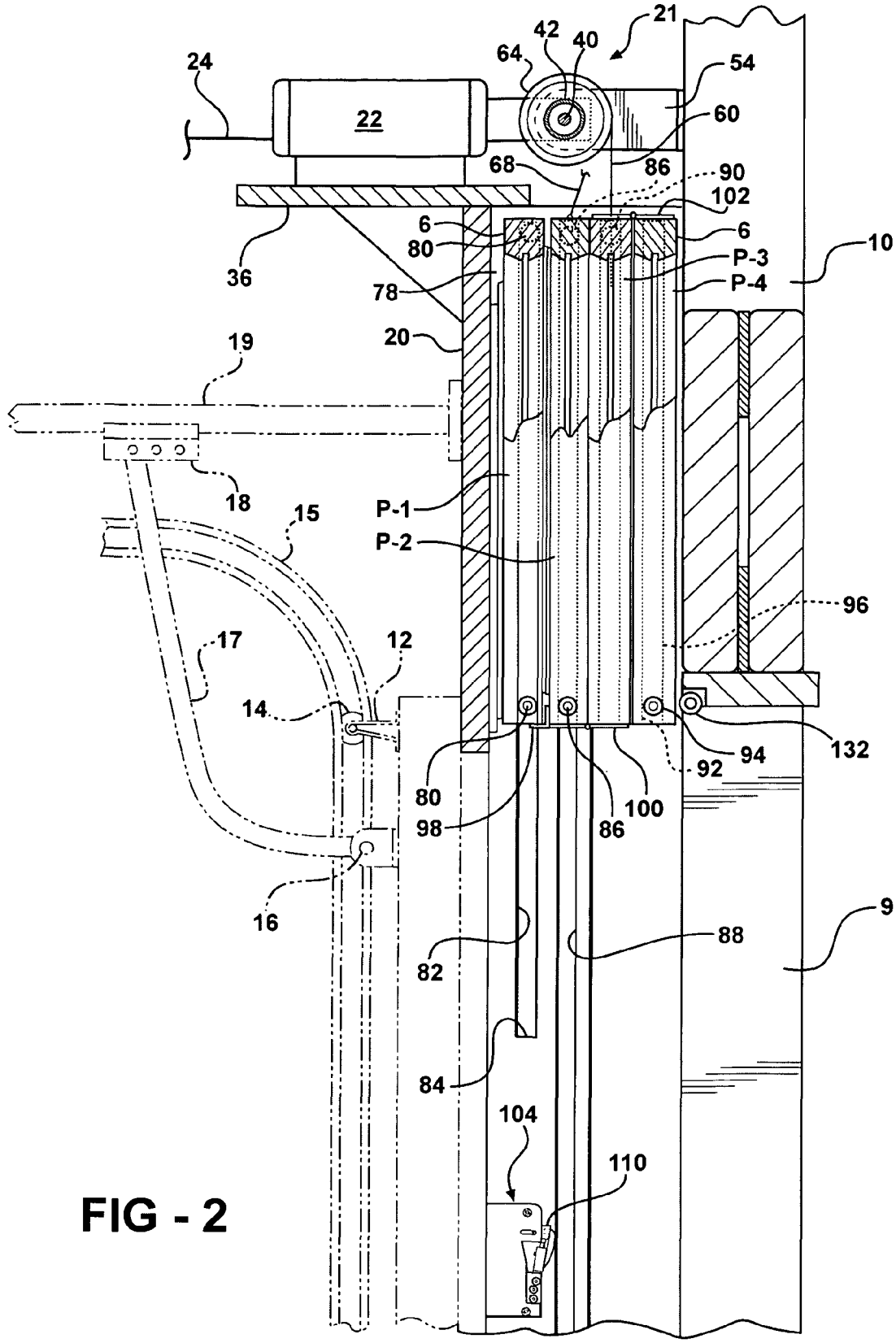
FIG. 2 is a fragmentary, enlarged, vertical sectional view illustrating a garage door in its doorway closing position and the screening panels in their elevated, stored position.

When the panels are in their elevated, stored position shown in FIG. 2 they are side-by-side and accommodated in a storage zone 78 between the member 19 and the header structure 10. The panel P-1 has at each of its opposite ends two vertically spaced guide rollers 80 which are accommodated in grooves 82, each groove having at its lower end a seat 84. The panel P-2 has a corresponding pair of vertically spaced guide rollers 86 which are accommodated in a vertically extending groove 88. The panel P-3 has only one guide roller 90 which is accommodated in a groove 92. The panel P-4 has a single guide roller 94 which is accommodated in a groove 96.

Figure 5:
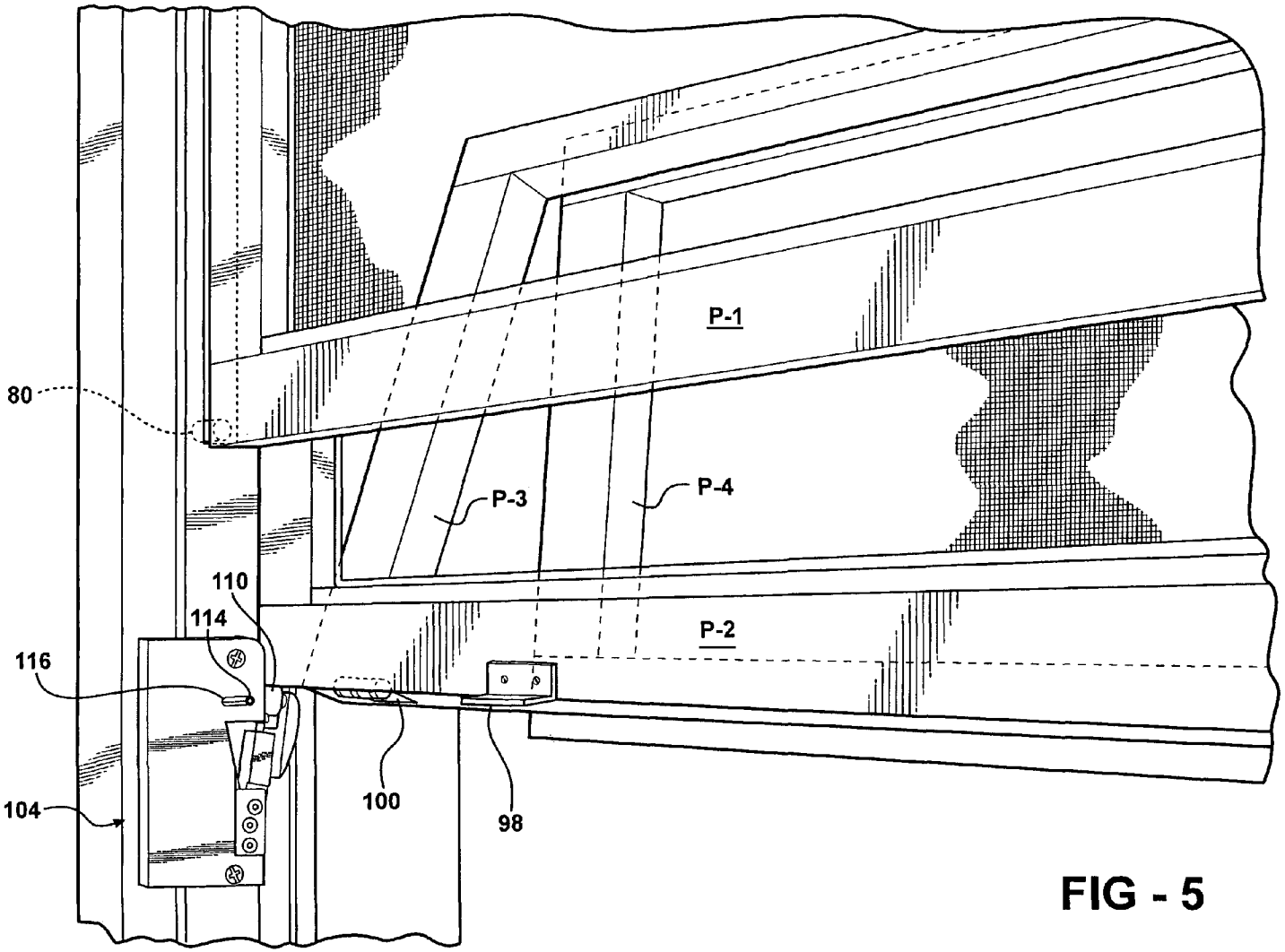
FIG. 5 is a fragmentary, isometric view of the screen panels in the position they occupy in FIG. 4.

The panel P-1 is not connected to any of the cables 60, 62, 68, 70 nor is such panel physically secured to any of the other panels. Accordingly, means must be provided to support the panel P-1 in its elevated, stored position. Suitable support means may comprise ball bearing side-mount drawer slides of the kind normally used to provide sliding support for a drawer movable into and out of a supporting cabinet. Such slides are attainable from Liberty Hardware, a subsidiary of Masco Company, of Winston-Salem, N.C. Such slides may be secured at opposite ends of the panel P-1 in the same manner that such slides are secured to a movable drawer and act in conjunction with the cabinet member secured to the end frame members forming the storage zone 78. Alternatively, the panel p-1 may be supported by L-shaped brackets 98 fixed to the bottom edge of the adjacent panel P-2 and upon which the bottom edge of the panel P-1 may rest. See FIGS. 2 and 5. The lower and free end of each hoist cable 60, 62 is fixed to that frame member 6 of the panel P-3 which then is uppermost, as is best shown in FIG. 2. Such cables are secured to the frame members 6 equidistant between the front and rear edges thereof. The arrangement is such that rotation of the spools 56, 58 in one direction enables the panel P-2, P-3, and P-4 to be lowered from the position shown in FIGS. 2 and 3, thereby enabling the panel P-1 also to be lowered. Lowering movement of the panel P-2 is guided by the guide rollers 86 and the guide grooves 88. The hoist cables, together with the interconnections between the panels, constitute the means for raising and lowering all of the panels.

The panel P-2 is connected to the panel P-3 by a hinge 100 which spans and is secured to each of the lower frame members 6 of the panels P-2 and P-3. The panel P-3 is secured to the panel P-4 by a hinge 102 which spans both frame members 6 of such panel and at the upper ends thereof.

As the panels P-1, P-2, P-3, and P-4 descend, the lower guide roller 80 of the panel P-1 will come to rest on the seat 84 of the groove 82, whereupon downward movement of the panel P-1 terminates. However, downward movement of the other panels continues under the control of the hoist cables until such time as the lower end of the panel P-2 reaches the level of a stop mechanism 104 at each of the opposite sides of the doorway. Each mechanism 104 has a housing 108 within which is a slideable bolt 110 biased by a spring 112 to a projected position in the path of downward movement of the panel P-2. Movement of the bolt 110 beyond its projected position is limited by a pin 114 movable in a slot 116 formed in the housing 108. In its projected position, the bolt 110 may bear against the bottom edge of the panel P-2 and interrupt its movement to a lower position.

The housing 108 carries a casing 118 pivoted at 120 on the housing 108 and within which is accommodated a spring biased screw 126 having a head 127 accommodated in an opening in the bolt 110. Carried by the receiver 122 is a positioning arm 128 having a cam surface 130 at its outer edge. The arm 128 projects into a guide slot 133 in the housing 108 in alignment with a slot at the free end of the bolt 110. In all positions of the panel P-2 above the stop mechanism 104 the arm 128 is in the projected position shown in FIGS. 4 and 5 so as to be engaged by and interrupt downward movement of the panel P-2 until such time as the bolt is displaced.

Figure 3:
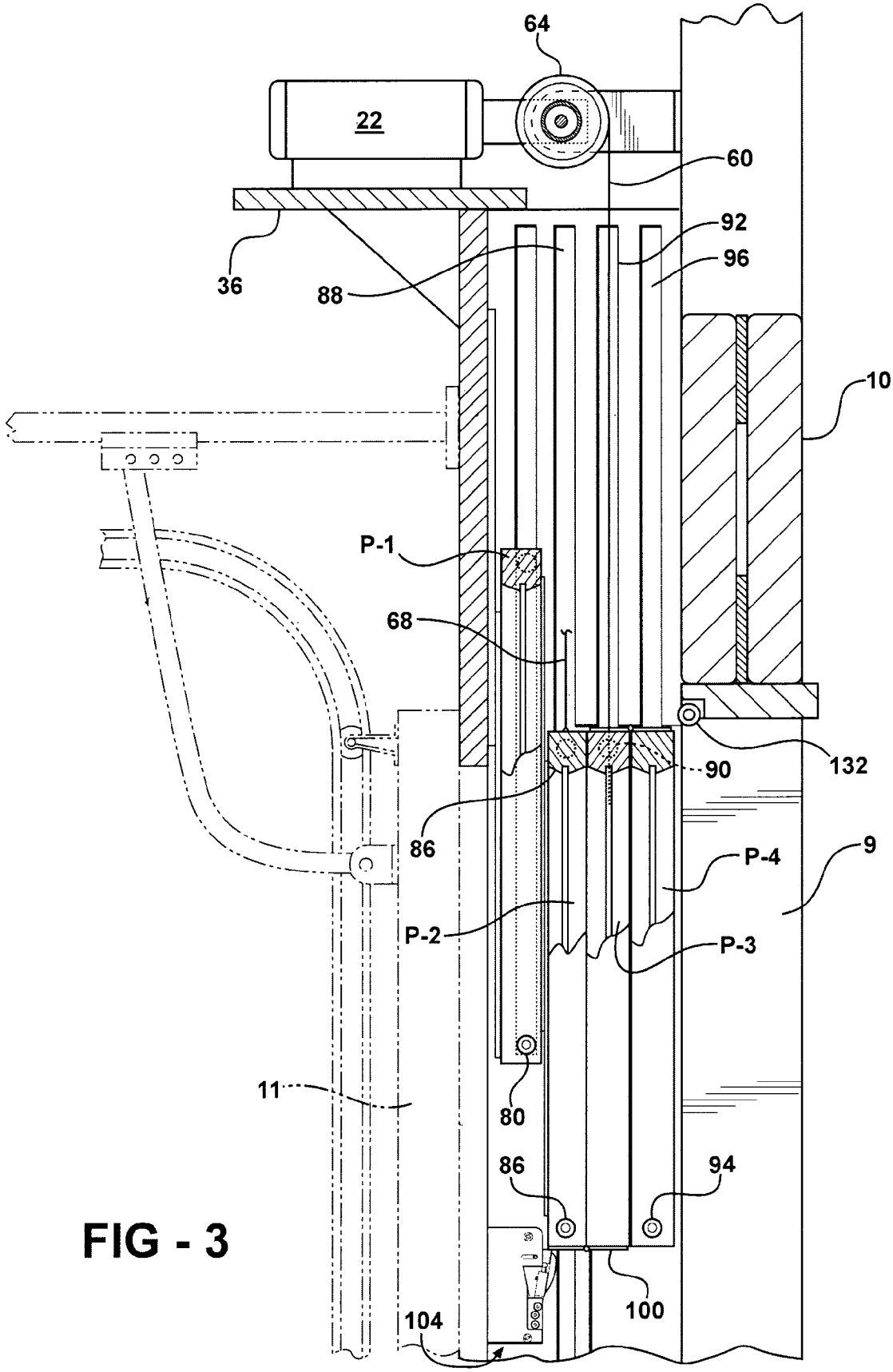
FIG. 3 is a view similar to FIG. 2, but illustrating the screen panels in downwardly adjusted positions.

When the panel P-1 reaches the position shown in FIG. 3, wherein the lower guide roller 80 engages the seat 84 of the groove 82, and when the panel P-2 engages the stop mechanism 104, the guide rollers 86 of the panel P-2 will be free of the guide groove 88. Since the panel P-2 is connected to the panel P-3 at the adjacent edges thereof by the hinge 100, and since the pivot joint of the hinge 100 is at one side of the vertical center line of the panel P-2, the panel P-3 has a tendency to rock clockwise from the position shown in FIG. 3 toward the position shown in FIG. 4, and because there will be no interference between the guide rollers 86 and 90 and the associated grooves 88 and 92, such movement of the panel P-3 is possible.

Lowering movement of the panel P-2 occurs under the influence of gravity as is permitted by extension of the cables 68 and 70, whereas lowering movement of the panels P-3 and P-4 occurs in response to the rotation of the shafts 44 and 46, their respective spools 56 and 58, and lowering movement of the lower ends of the hoist cables 60 and 62. The drive shaft 40 rotates continuously once lowering movement of the screen panels commences, as do the shafts 44 and 46, due to their being pinned to the shaft 40, but when the downward movement of the panel P-2 is interrupted the rotation of the shaft 42 also is interrupted along with the rotation of the spools 64 and 66. However, the shafts 44 and 46, together with their respective spools 56 and 58, continue to rotate thereby enabling the hoist cables 60, 62 to be unwound, and the panel P-3 to move clockwise toward the position shown in FIG. 4. To minimize any wear that may be due to rubbing of the cables 60, 62 on any part of the header, pulleys 132 may be provided to accommodate the cables.

Figure 4:
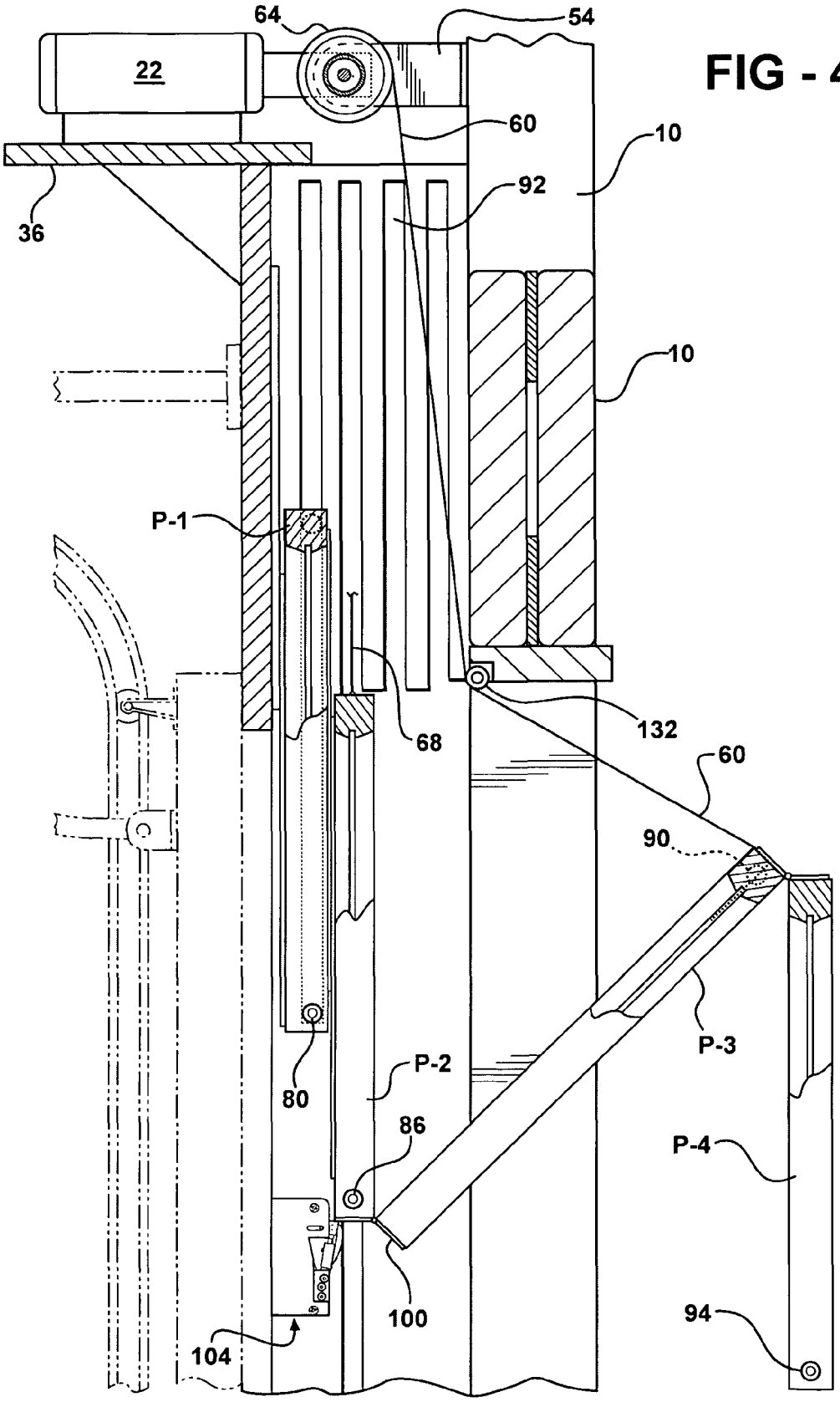
FIG. 4 is a view similar to FIG. 3, but illustrating the panels in further downwardly adjusted positions.
Figure 6:
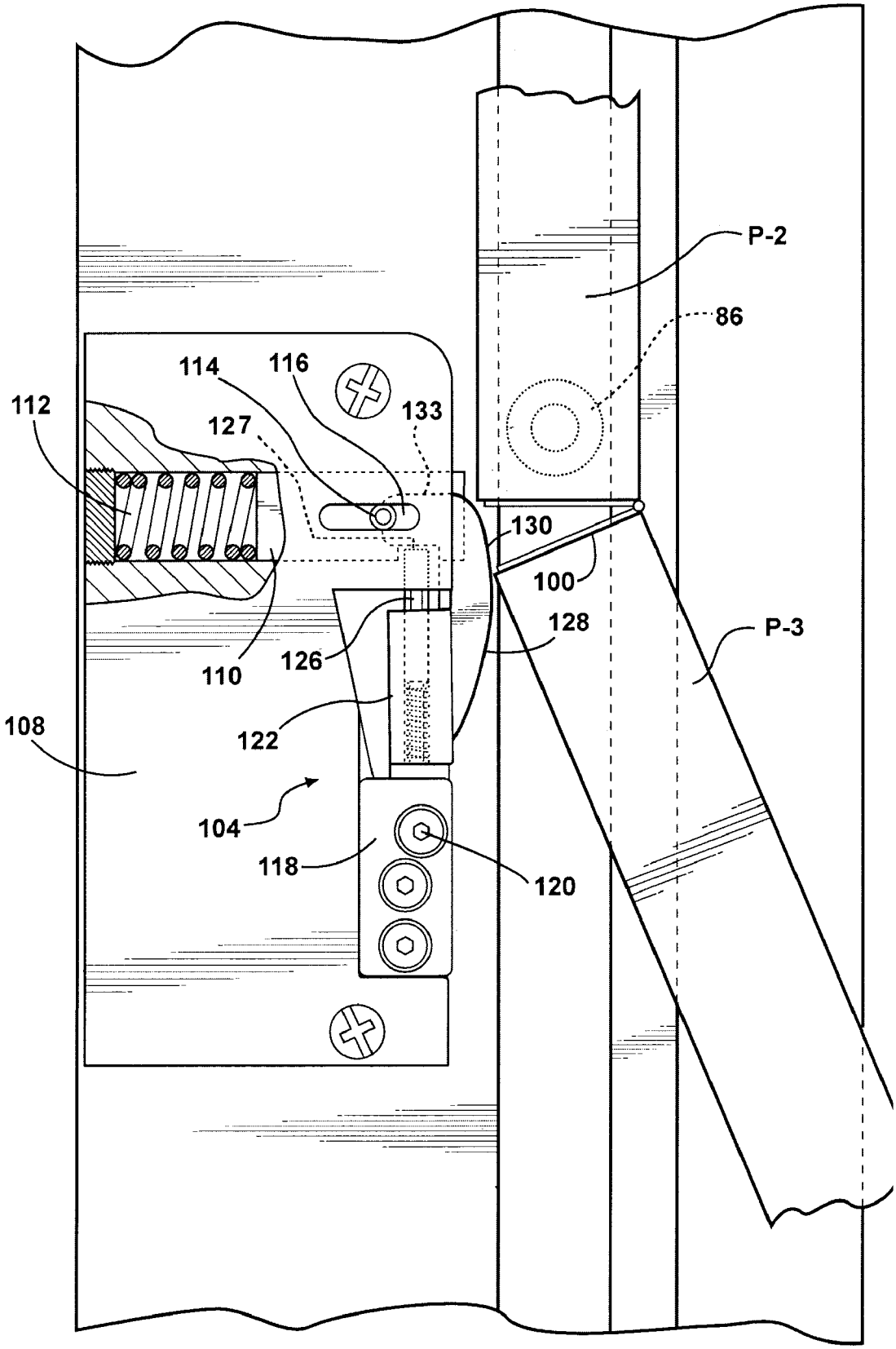
FIG. 6 is a fragmentary, side elevational view, partly in section, illustrating two of the screen panels in positions of further downward adjusted position.
Figure 7:
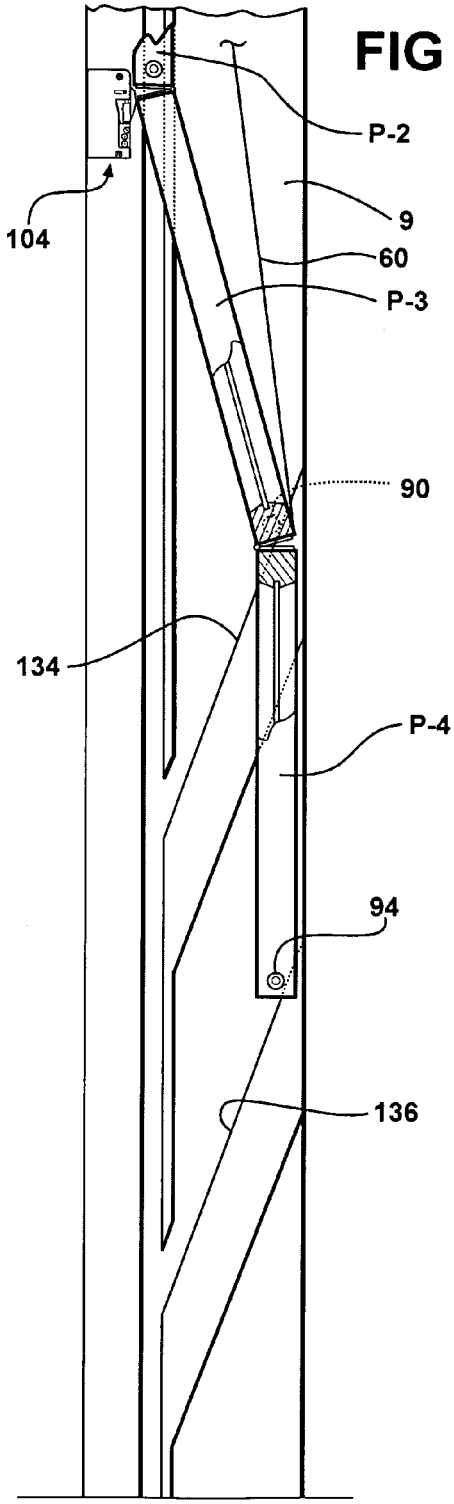
FIGS. 7 and 8 are fragmentary, side elevational views, partly in section, illustrating some of the screen panels in positions they occupy as they approach their final, doorway screening positions.
Figure 8:
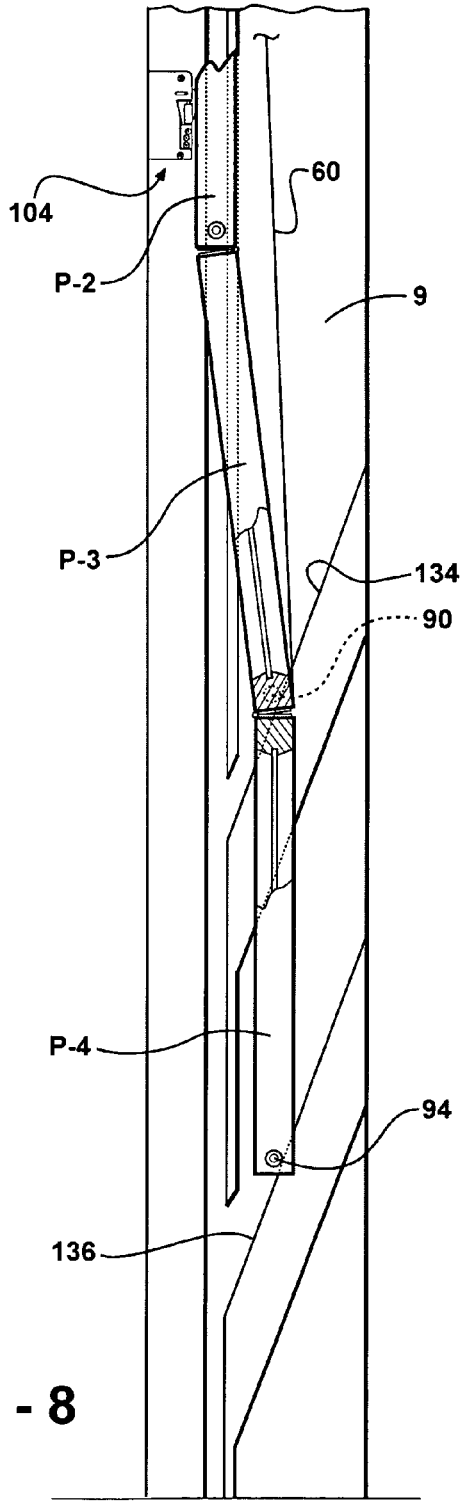

Clockwise rocking of the panel P-3 will continue from the position shown in FIG. 4 toward the position shown in FIG. 6.

As the panel P-3 swings clockwise from the position shown in FIG. 4 to the position shown in FIG. 6, one edge of the panel P-3 will bear against the arm 128 and displace the bolt 110 from the path of the panel P-2, thereby enabling the latter to move past the stop mechanism and continue its downward movement.

As the panel P-3 moves toward and downwardly beyond the position shown in FIG. 6, the panel P-4 will swing about the hinge 102 by gravity to a position underlying the panel P-3.

As the panels P-3 and P-4 continue to move downwardly and swing about their respective hinges 100 and 102, the guide rollers 90 and 94 will enter two downwardly inclined guide grooves 134 and 136 in the doorway frame members 9 and move therealong. As downward movement of the panels P-3 and P-4 continues, the guide grooves will guide the panels P-3 and P-4 to the positions shown in FIG. 9 in which all three panels P-2, P-3, and P-4 are in vertical prolongation of one another and coplanar at eye level and below. At this point downward movement of the panels will discontinue and the drive motor 22 will cease operating.

Figure 9:
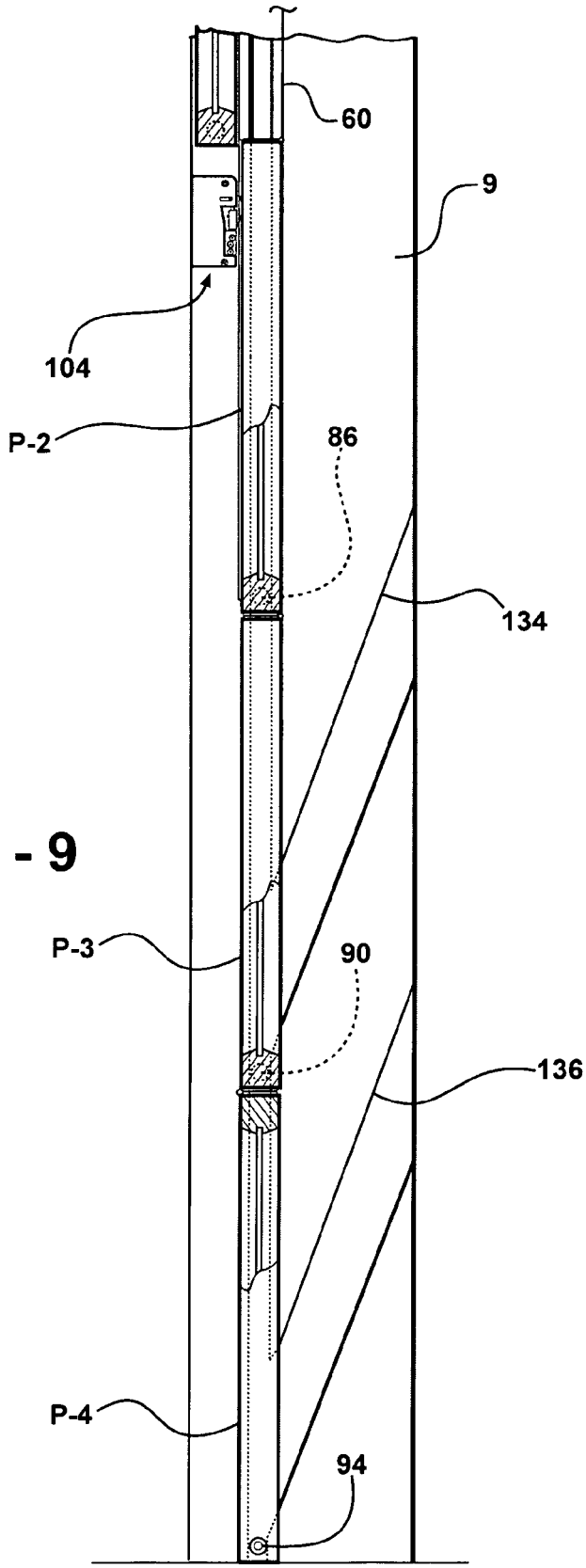
FIG. 9 is a view similar to FIGS. 7 and 8 but showing the screen panels in their final doorway screening positions.

When the panels are in the positions shown in FIGS. 1 and 9, the adjacent corner edges of the panels P-1 and P-2 will abut one another, but the arrangement is such that the panel P-2 may move vertically upward, when necessary, relative to the panel P-1.

When the panels are in the positions shown in FIG. 9, the panel P-2 will bear against the arm 128 of the stop mechanism 104 which will be pressed by the spring 112 firmly against the panel P-2 and assist in avoiding rattling of the screen in windy conditions.

When it is desired to return the screen panels from their extended, doorway closing positions to their raised, stored positions, the drive motor 22 may be energized so as to rotate the drive shaft and the spools in such direction as to wind the cables on the respective spools. As such winding commences, the cables 60 and 62 will initiate upward movement of the panel P-3 which will be transmitted to the panels P-2, and P-4 so as to position the guide rollers 90 and 94 on the panels P-3 and P-4 to enter the respective guide grooves 134 and 136. Continued rotation of the spools 56, 58, 64, and 66 will enable the cables 60 and 62 to effect swinging movements of the panels P-3 and P-4 from the position shown in FIG. 9 to the positions shown in FIGS. 4 and 5 and thence to the positions shown in FIG. 6. As the panel P-2 moves upwardly from the position shown in FIG. 9 the panel P-2 will disengage the cam arm 128, thereby repositioning the bolt 110 in condition to interrupt downward movement of the panels below the level of the bolt 110.

As the panels approach the storage zone 78 they will return to their side-by-side relationship and enter the storage zone. In this position the panels are completely clear of the doorway and positioned in such manner as not to interfere with utilization of space in the garage above the level which the garage door and the screening panels occupy when the garage doorway is open. Furthermore, since the screen portions of the panels are vertical when the panels are in their stored positions, the likelihood of dust and other unsightly debris collecting on the screens of the panels is minimized.

The disclosed embodiment is representative of a presently preferred form of the invention, but the disclosure is intended to be illustrative, rather than definitive of the invention. The invention is defined in the claims.

I claim:

1. Apparatus for screening a doorway of selected area comprising a plurality of screen panels together having a combined area corresponding substantially to that of said doorway;

a plurality of grooves accommodating said screen panels for movements between a stored position in which said screen panels are all positioned by an individual groove for each said screen panel and clear of and above said doorway, and an operative position in which said screen panels together screen said doorway;

the plurality of grooves accommodating movement of said screen panels along paths relative to one another between said positions;

wherein said screen panels when in said stored position are vertical, side-by-side and at substantially the same level;

a plurality of hinges connecting a portion of said plurality of screen panels to one another for relative pivotal movement as said screen panels move from one of said positions toward the other of said positions; and a plurality of guides carried by each of said screen panels for guiding such screen panels in response to the movement thereof between said positions.

2. The apparatus according to claim 1 wherein said screen panels when in said operative position extend substantially the full height and width of said doorway.

3. The apparatus according to claim 1 wherein when said screen panels are in said operative position those screen panels which are hingedly connected to one another are substantially coplanar.

4. The apparatus according to claim 1 wherein during movement of said screen panels from said stored position toward said operative position said plurality of said screen panels automatically swing by gravity about said plurality of hinges.

5. Apparatus according to claim 4 including a stop housing holding a stop in a position to interrupt movement of one of said screen panels toward said operative position, said stop housing mounted in a fixed position in which the stop is engaged by another of said screen panels in response to swinging of said another of said panels about at least one of said plurality of hinges, the swing of said another of said screen panels enabling the latter to displace said stop, thereby enabling said one of said screen panels to continue movement toward said operative position.

6. The apparatus according to claim 5 wherein said stop comprises a movable stop member, a spring biasing said stop member to a position to be engaged by said one of said screen panels, said movable stop member also being engageable by said another of said screen panels during swinging movement thereof, engagement of said stop member by said another of said screen panels overcoming said spring and enabling said stop member to be displaced to a position free of engagement of said one of said panels.

7. The apparatus according to claim 1 including a panel drive assembly, for effecting said movements of said screen panels, comprising a pair of hoist cables, that are extensible and retractable, coupled to one of said plurality of said screen panels for raising and lowering said one of said screen panels, said one of said screen panels being hingedly connected by at least one hinge of said plurality of hinges to another of said plurality of said screen panels at such position that swinging movement of said one of said plurality of said screen panels initiates swinging movement of at least three of said plurality of screen panels relative to each other.

8. The apparatus according to claim 7 wherein the at least three screen panels of said plurality of said screen panels are connected to one another by said plurality of hinges.

9. The apparatus according to claim 1 wherein each of said screen panels comprises a frame encircling a screen spanning said frame.

10. Apparatus slideably closing and opening a doorway formed by an upper, substantially horizontal header and a pair of parallel, spaced side frame members, a panel storage zone adjacent said header and above said doorway;

a plurality of panels together having an area corresponding substantially to that of said doorway;

wherein said panels when in said storage zone are vertical, side-by-side and at substantially the same level;

a panel drive assembly for moving each of said plurality of panels from said storage zone downwardly to positions in which said plurality of panels together form a closure for said doorway;

a pair of drive transmitting brackets for moving a first panel of said plurality of panels vertically between an elevated position in said panel storage zone to a lowered position in which said first panel of said plurality of panels closes an upper portion of said doorway;

a pair of hoist cables for moving a second panel of said plurality of panels relative to said first panel of said plurality of panels from a position in said panel storage zone to a lowered position in which said second panel closes a second portion of said doorway;

said pair of hoist cables and a first hinge for moving a third of said plurality of panels from a position in said storage zone and relative to said second panel to a lowered position in which said third panel closes a third portion of said doorway;

a second hinge for moving a fourth panel of said plurality of panels from a position in said storage zone to a lowered position adjacent said third panel and in which said fourth panel closes a fourth portion of said doorway;

a first guide reacting between said first panel and said frame members for guiding said first one of said panels from said raised position to said lowered position;

the first hinge connecting said second panel to said third panel for enabling said third panel to swing from an elevated position to a lower position in response to movement of said second panel to said lowered position a second hinge connecting said third panel to said fourth panel enabling the latter to swing from a raised position to a lower position in response to movement of said third panel to its said lower position; and a plurality of guide rollers reacting between a first side frame member and a second side frame member as said third and fourth panels move to their respective lower positions for positioning said fourth panel beneath and substantially coplanar relative to said third panel.

11. The apparatus according to claim 10 wherein each of said plurality of panels comprises a panel frame encircling a screen.

12. The apparatus according to claim 10 including a force transmitting motor connected to said third panel by said pair of hoist cables including a first hoist cable and a second hoist cable for moving said third panel vertically between said stored and said lowered positions.

13. The apparatus according to claim 12 where in said motor is a reversible drive motor that moves said third panel vertically.

14. The apparatus according to claim 10 including a stop mechanism in the path of downward movement of said second panel for interrupting said downward movement thereof.

15. The apparatus according to claim 14 wherein said third panel swings relative to said second panel to effect withdrawal of an arm of said stop mechanism from the path of downward movement of said second panel.

16. The apparatus according to claim 15 wherein said arm of said stop mechanism has a cam surface engaged by said third panel in response to vertical movement of said third panel, said cam surface being operable to effect said withdrawal of said arm of said stop mechanism in response to vertical movement of said third panel.

17. The apparatus according to claim 15 wherein said arm of said stop mechanism is so positioned that swinging movement of said third panel is precluded until said second panel engages said stop mechanism.

18. The apparatus according to claim 10 including a limit member in the path of downward movement of said first panel for engaging said first panel and terminating such downward movement of said first panel.

19. The apparatus according to claim 15 including a plurality of guide rollers carried by said third and fourth panels and a plurality of guide grooves in said pair of parallel spaced side frame members engageable with said plurality of guide rollers in response to movement of said third and fourth panels for guiding said third and fourth panels to positions in which said third and fourth panels are vertical and substantially coplanar.

* * * * *